US010837741B2

(12) United States Patent
Wilton

(10) Patent No.: US 10,837,741 B2
(45) Date of Patent: Nov. 17, 2020

(54) PROPELLANT CHARGE CONTAINER

(71) Applicant: BAE SYSTEMS plc, London (GB)

(72) Inventor: Anne Marie Wilton, Renfrewshire Strathclyde (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 16/347,233

(22) PCT Filed: Oct. 19, 2017

(86) PCT No.: PCT/GB2017/053159

§ 371 (c)(1),
(2) Date: May 3, 2019

(87) PCT Pub. No.: WO2018/083439

PCT Pub. Date: May 11, 2018

(65) Prior Publication Data

US 2019/0331467 A1 Oct. 31, 2019

(30) Foreign Application Priority Data

Nov. 4, 2016 (GB) ..... 1618624.9

(51) Int. Cl.
*F42B 5/192* (2006.01)
*F42B 5/38* (2006.01)
*F42B 5/30* (2006.01)

(52) U.S. Cl.
CPC ..... *F42B 5/192* (2013.01); *F42B 5/38* (2013.01); *F42B 5/30* (2013.01)

(58) Field of Classification Search
CPC .. F42B 5/181; F42B 5/192; F42B 5/18; F42B 5/38
See application file for complete search history.

(56) References Cited

U.S. PATENT DOCUMENTS 2,419,949 A * 5/1947 Hottinger ..... F42B 5/38 102/469
2,432,706 A * 12/1947 Anderson ..... F42B 5/38 102/464

(Continued)

FOREIGN PATENT DOCUMENTS

AU 778762 B1 12/2004
CA 002990862 A1 * 2/2016 ..... F03D 1/0625

(Continued)

OTHER PUBLICATIONS

International Search Report and Written Opinion received for PCT Application No. PCT/GB2017/053159, dated Dec. 21, 2017. 10 pages.

(Continued)

*Primary Examiner* — Gabriel J. Klein
(74) *Attorney, Agent, or Firm* — Finch & Maloney PLLC

(57) ABSTRACT

The disclosure relates to a charge container device, said charge container device having a volume suitable to substantially fill a barrel chamber, said charge container device is formed from a substantially rigid and combustible material, wherein said charge container device comprises at least one wall to define a cavity for the retention of at least one cartridge case, said at least one cartridge case comprising an energetic material, wherein said at least one cartridge case is arranged in a stacked formation within said charge container, the charge container device further comprising a base portion and a top portion, wherein the top portion comprises an aperture to allow for expulsion of energy and the base portion comprising an ignition means.

20 Claims, 5 Drawing Sheets

(56) References Cited

U.S. PATENT DOCUMENTS

Figure 1A:
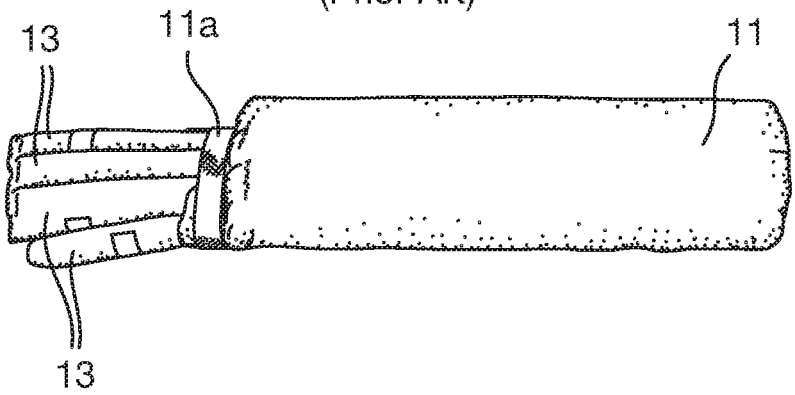
Fig. 1a (Prior Art)

| | | | | | |
|---|---|---|---|---|---|
| 3,407,735 | A * | 10/1968 | Gahle | F42B 3/02 | 102/530 |
| 4,709,636 | A | 12/1987 | Mueller et al. | | |
| 5,090,323 | A * | 2/1992 | Kallevig | F42B 5/18 | 102/282 |
| 5,212,342 | A * | 5/1993 | Eches | F42B 5/181 | 102/317 |
| 5,263,416 | A | 11/1993 | Amundson et al. | | |
| 5,282,423 | A | 2/1994 | Sikorski et al. | | |
| 6,305,288 | B1 * | 10/2001 | Nilsson | F42B 5/38 | 102/288 |
| 6,666,141 | B2 * | 12/2003 | Hagerty | F42B 5/16 | 102/282 |
| 2009/0266263 | A1 | 10/2009 | Quesenberry et al. | | |

FOREIGN PATENT DOCUMENTS

| | | | | |
|---|---|---|---|---|
| DE | 1123953 B * | 2/1962 | F42B 5/38 | |
| DE | 3927400 C2 * | 9/1993 | C06B 27/00 | |
| FR | 803967 A * | 10/1936 | F42B 5/38 | |
| FR | 2684176 A1 * | 5/1993 | F42B 5/181 | |
| FR | 2684176 A1 | 5/1993 | | |
| GB | 2284652 A * | 6/1995 | F42B 5/18 | |
| JP | 3203573 B2 | 5/1996 | | |
| JP | 2006071236 A * | 3/2006 | | |
| JP | 2006071236 A | 3/2006 | | |
| WO | 2018083439 A1 | 5/2018 | | |
| WO | 2018083440 A1 | 5/2018 | | |

OTHER PUBLICATIONS

GB Search Report under Section 17(5) received for GB Application No. 1618624.9 dated May 5, 2017. 3 pages.

International Preliminary Report on Patentability received for PCT Application No. PCT/GB2017/053159, dated May 7, 2019. 7 pages.

International Preliminary Report on Patentability received for PCT Application No. PCT/GB2017/053160, dated May 7, 2019. 8 pages.

International Search Report and Written Opinion received for PCT Application No. PCT/GB2017/053160, dated Dec. 21, 2017. 11 pages.

* cited by examiner

PROPELLANT CHARGE CONTAINER

The present disclosure relates to a charge container device, for use as a charge for propelling munitions, more specifically related to the area of modular charge containers.

Within the field of munitions a projectiles range may be achieved by utilising an explosive train sequence, which may comprise an igniter, a primer with an intermediate explosive and an output charge. The explosive train serves to take a small energetic event and amplify the output as it moves through the explosive train.

In military use, an explosive train sequence is often used in the launching of munitions, whether direct or indirect; to propel a shell over a distance, often considering a minimum launch distance to prevent injury to own troops or large distances to reach long range. To accomplish an explosive train sequence relating to a specific distance, an ignition means is incorporated alongside a charge, with additional charges being added or subtracted depending on the distance the shell is to travel.

The construction of an explosive train sequence may be carried out modularly; this can be done in a number of ways depending on the system used and various other user requirements or conditions (e.g. variations of distances where opposition forces are engaged).

One example of the use of a combination of charges to achieve a launch distance is to load modular charges individually into the breech until the desired total charge is achieved. Each charge contains an energetic material and is made from a rigid, combustible case and may be of different sizes, which correspond to a predetermined distance they are able to propel a shell. Each charge comprises a recessed and extruded portion to allow them to fit together as they are loaded into the breech in order to prevent adverse movement. In use the ignition means on the case (e.g. an igniter pad) is struck and causes an explosive train sequence to begin, which continues through the charges until the force expels the shell from the barrel of the weapon.

This method suffers as the explosives train is formed by utilising the individual charges loosely coupled together utilising the recess/extrusions provided, making rapid movement or formation of a desired charge time consuming. The charges themselves are also formed from a rigid outer case containing loose energetic material and as a result hold no flexibility for rapid change of energetic material quantity if needed.

Another example is utilising a chain of combustible bags, combustible in this context refers to the fact that the bags are fully consumed following burning, rather than providing further energetic output. These combustible bags are filled with a set quantity of energetic material, relating to different distances the shell is to be launched. These bags may be placed into a single, larger combustible bag (e.g. cotton), with an igniter pad at the base wherein the total number of bags contained within relate to a specific distance. Alternatively the number of required bags is placed in an initial combustible bag, which comprises a number of ties that may be brought up around the combustible bags to hold them in place. When required to be used the larger bag or combustible bag chain is taken and placed in its entirety into the breech. Upon firing the ignition begins the explosive train, which travels up through the bags, firing the shell over the desired distance and combusting the bag in the process, allowing the breech to be clear for the next shell and charge.

This method has significant cost savings and flexibility as the use of a large single bag to contain smaller charges means that a single bag, relating to a distance can be moved around and is not costly to produce. Its lack of rigid structure does however make handling difficult and a cotton material can be prone to snagging and tears. Further to this the adding of single bags to a larger container can be subject to human error and mistakes, such as the addition of the wrong charge or omission of a charge, may cause a launch to overshoot or undershoot its target. These human errors may increase during periods of high stress, such as conflict.

A final example involves a single full length master combustible bag with individual "elongate sticks" of energetic material contained in individual full length combustible bags. There is a selection of different combustible bags which are filled with different specific amounts of propellant. The sticks, once in their combustible bags are arranged to run the full length of the single master combustible bag. In use an ignition pad at the bottom of the single master combustible bag is struck and causes the "elongate sticks" of energetic material to react and burn from the base of the master bag up through the "elongate stick".

This method has the advantage that it is easier to add or remove the combustible bags of energetic material to the single master combustible bag. As a result the distance a shell is to travel may be adjusted as required. Like other methods however this method is prone to human error resulting in the incorrect arrangement of combustible bags or damage to the combustible bags during handling.

The present disclosure herein aims to address the issues presented in the background prior art by solving issues in robustness, flexibility and usability.

According to a first aspect of this disclosure there is provided a charge container device, said charge container device having a volume suitable to substantially fill a barrel chamber, said charge container device is formed from a substantially rigid and combustible material, wherein said charge container device comprises at least one wall to define a cavity for the retention of at least one cartridge case, said at least one cartridge case comprising an energetic material, wherein said at least one cartridge case is arranged in a stacked formation within said charge container, the charge container device further comprising a base portion and a top portion, wherein the top portion comprises an aperture to allow for expulsion of energy and the base portion comprising an ignition means.

The barrel chamber is the portion of barrel which has a volume in which the propellant is located. The volume is between the breech and the rear face of the projectile, this will be standard for each barrel type.

The charge container may preferably be produced as a single unit, whose volume, that is length and diameter, may be selected depending on the breech it is designed to fit, such that in use the charge container device substantially fills the barrel chamber. The internal cavity may provide a predefined volume to specifically allow modular cartridge cases with standard amounts and type of energetic material. The charge container may be constructed from a substantially rigid material, such that in use the material is capable of supporting the mass of propellant without buckling or tearing. Further the material is a combustible material, such as, for example, an impregnated paper or card, but preferably a Nitrocellulose and Kraft mix, which allows the charge container to be handled easily, however will combust and during use leaving substantially no residue to prevent the need to clean the barrel between uses or remove debris prior to loading a new shell or charge container device into the breech. Substantially filling the breech of a gun allows a single charge container to be used without significant loss of energy during firing, however providing the flexibility of having its overall energetic output being determined by the amount of cartridge cases contained within.

In preferred arrangement there is provided a first fixed cartridge case at the charge container device's base portion to ensure the charge container is capable in use of launching a projectile to a minimum distance and one or more further cartridge cases. The use of a fixed cartridge case, provides a safety mechanism that there is sufficient propellant to launch a projectile to a distance that is safe from the operators.

In one arrangement the charge container comprises a plurality of further cartridge cases, which may be added or removed from the charge container depending on the desired launch distance. The plurality of cartridge cases may be stacked one on top the other, as additional cartridge cases are added, so that they are horizontally stacked, such that they are coaxially aligned.

The cartridge cases may comprise a base and a top and may be filled with an energetic material, in the form of pellets or grains. The cartridge cases may be reversibly attached to additional cartridge cases, for example by a hook and loop arrangement; alternatively the base may comprise a recessed portion and the top may comprise an extruded portion in order to facilitate the linking of cartridge cases by the insertion of an extruded surface of a top portion into the recessed portion of the base of a further cartridge case.

In an alternative arrangement both base and top of a cartridge case may be substantially flat, however with an abrasive surface or a surface with raised portions to increase the co-efficiency of the two surfaces in order that when a top portion and a base portion are in contact they are sufficiently resilient to movement.

The cartridge case may be formed from a rigid or flexible material, however in a preferred embodiment the cartridge case may be a flexible material such as cotton or polyester, as it is cheaper and faster to manufacture as well as providing a simpler system to add the energetic material.

An igniter pad may also be included at the base of each individual cartridge case to be used as a means of igniting the energetic material of individual cartridge cases, providing a greater means of flexibility.

In an alternative arrangement cartridge cases may be shaped to provide a central void, to accept the insertion of a central core igniter, allowing a means to ignite the energetic material in a more uniform manner, rather than from the base upward.

The one or more further cartridge cases may be housed in the cavity, preferably being reversibly attached to the wall of the charge container by a fixing means. This reversible means may comprise a hook and loop attachment (e.g., Velcro®) or in a preferred arrangement the cartridge case may be held in place utilising spacers attached to the internal wall of the cavity. The spacers may hold each further cartridge case under friction and advantageously ensure a space between the external wall of the further cartridge case and the internal wall of the charge container between 1 mm and 10 mm, said space allowing for the propagation of a flame from either side of said further cartridge case during the explosive train. The use of spacers provides a more uniform explosive energy output and may provide a flash path for thermal output and flame propagation, allowing the device to utilise the areas created by the spacers to ensure even ignition of the cartridge case and energetic material.

The energetic material within the fixed cartridge and one or more further cartridge cases may be a material such as a pyrotechnic, propellant or high explosive composition. This energetic material may be in the form of pellets, granules or powder.

The base portion of the charge container may comprise an igniter pad, said igniter pad being present to aid in the initiation of the explosive train and may contain an energetic material such as a propellant or pyrotechnic.

In an alternative arrangement the base pad may provide the means for striking a central core igniter running the length of the charge container in order to provide a uniform ignition to all the cartridge cases contained within the cavity.

Whilst the present disclosure has been described above, it extends to any inventive combination of the features set out above, or in the following description, drawings or claims.

Exemplary embodiments of the device in accordance with the present disclosure will now be described with reference to the accompanying drawings in which:

FIG. 1*a* shows a prior art example of a charge bag, where a number of elongate charges have been added to the charge bag.

Figure 1B:
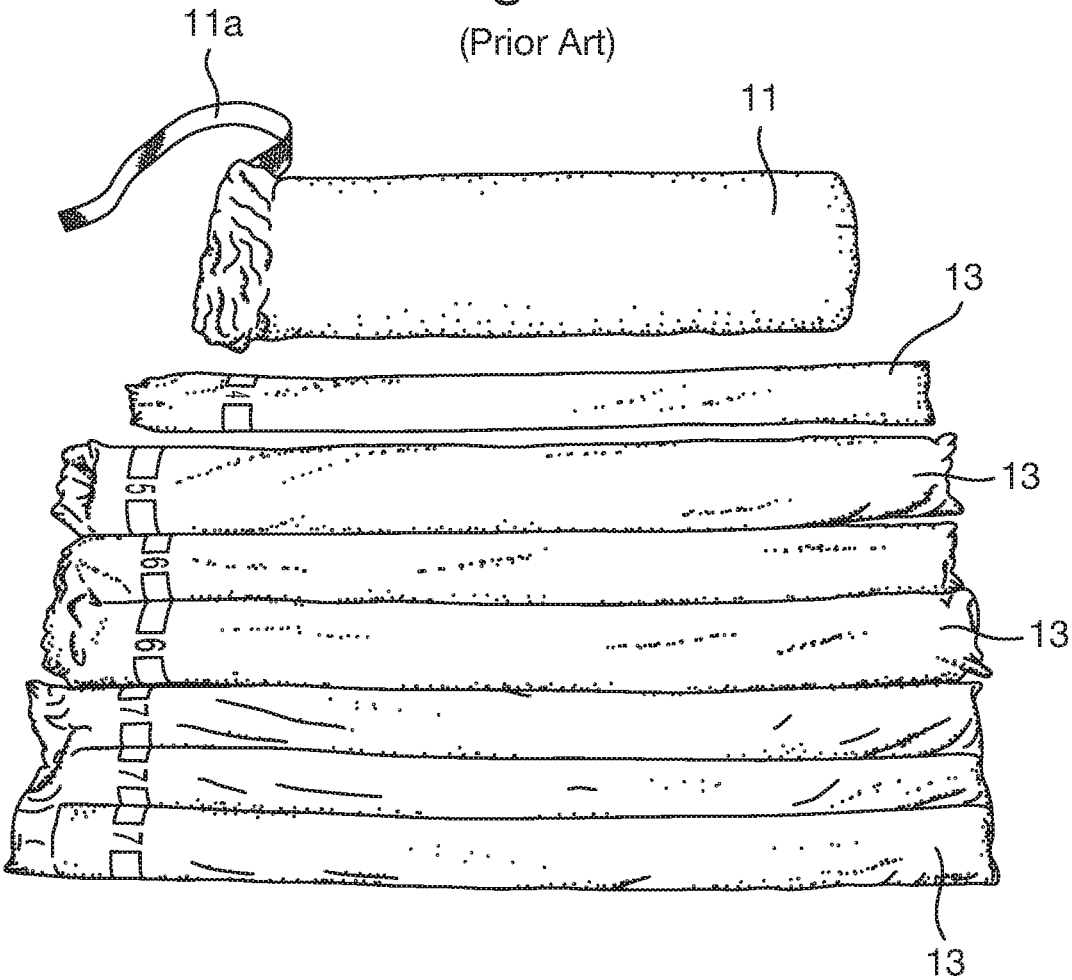
Fig. 1b (Prior Art)

FIG. 1*b* shows a prior art example of the unpacked charge bag of FIG. 1*a*, with various elongate charges shown.

Figure 2A:
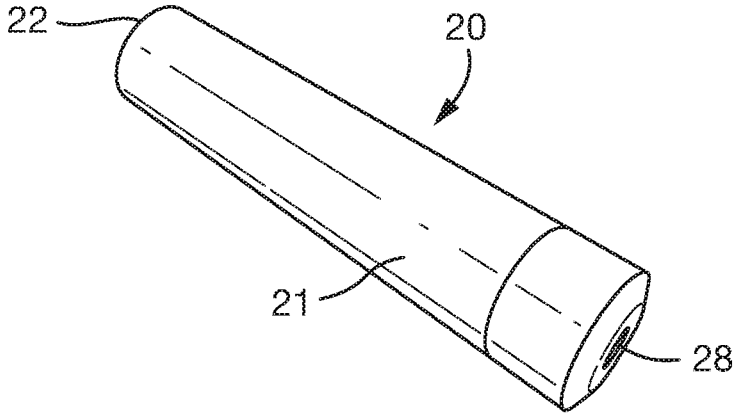

FIG. 2*a* shows an example of a charge container from a side and base view.

Figure 2B:
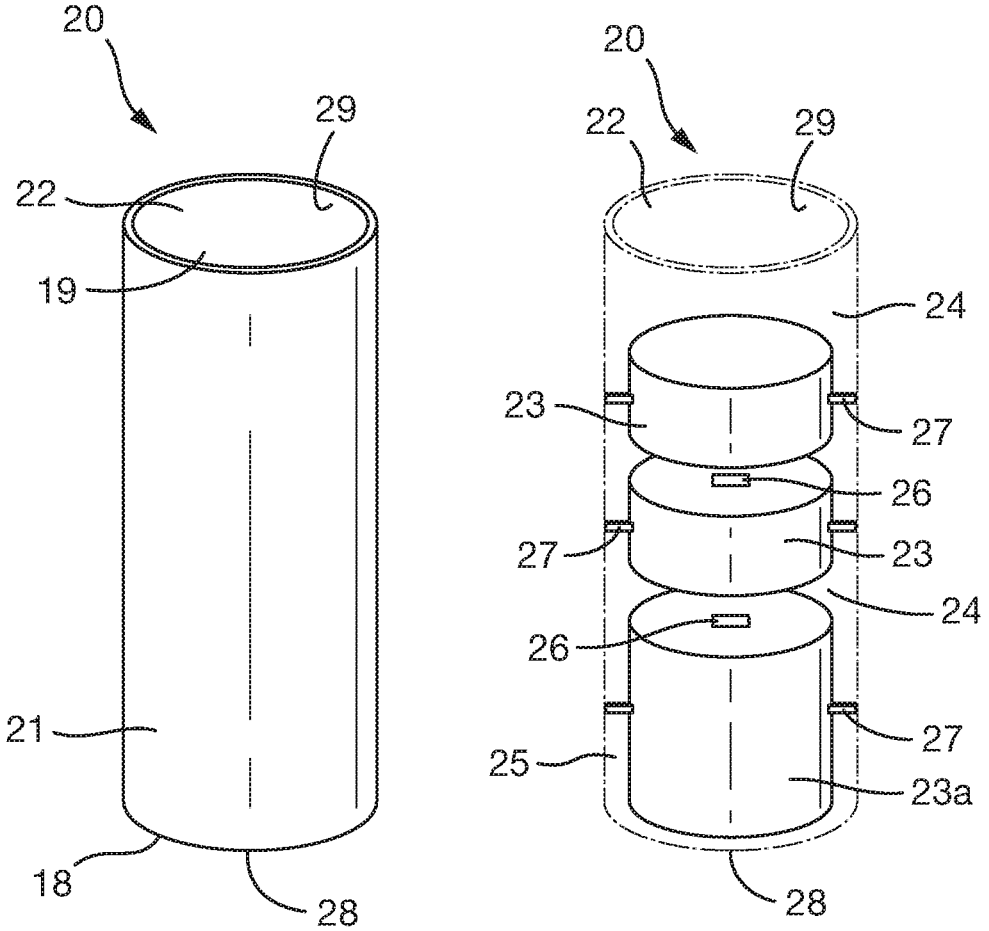

FIG. 2*b* shows a cross-section of an example charge container including inserted cartridge cases.

Figure 3A:
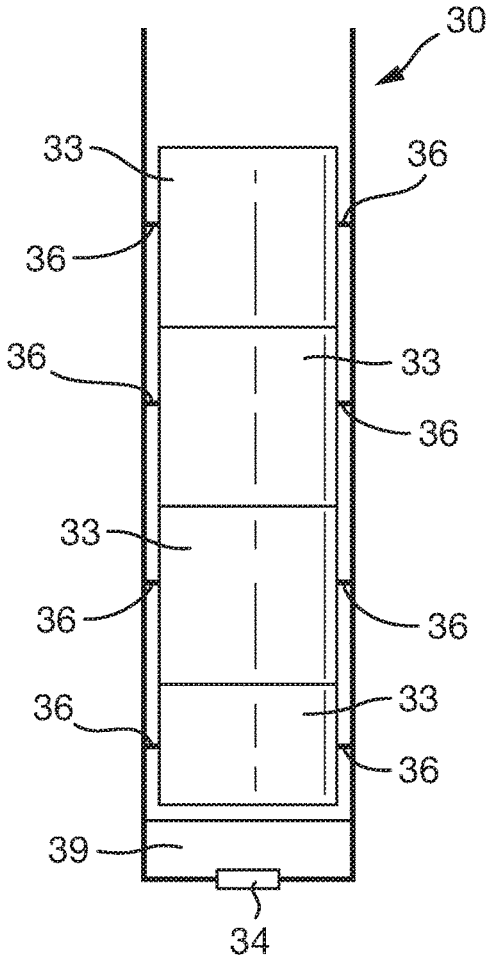

FIG. 3*a* shows a schematic of an embodiment of the charge container which includes an inbuilt cartridge case as part of the charge container, as well as further removable cartridge cases.

Figure 3B:
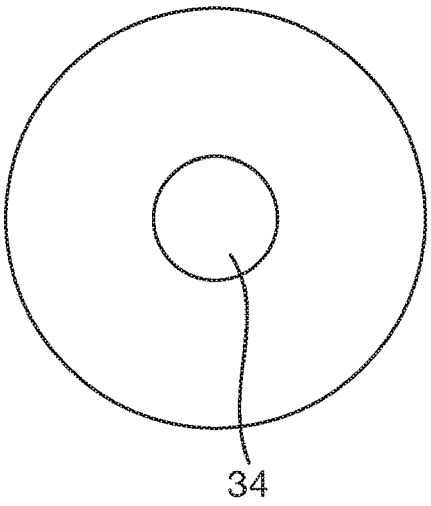

FIG. 3*b* shows a schematic of the base of 3*a* with igniter pad fitted as ignition means.

Figure 3C:
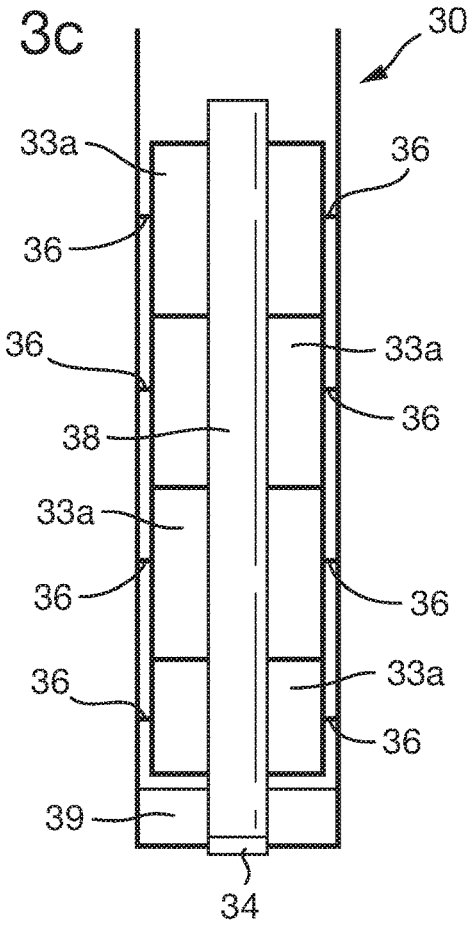

FIG. 3*c* shows an alternative embodiment of the schematic of 3*a* utilising a central core igniter ignition means with cartridge cases fitted.

Figure 3D:
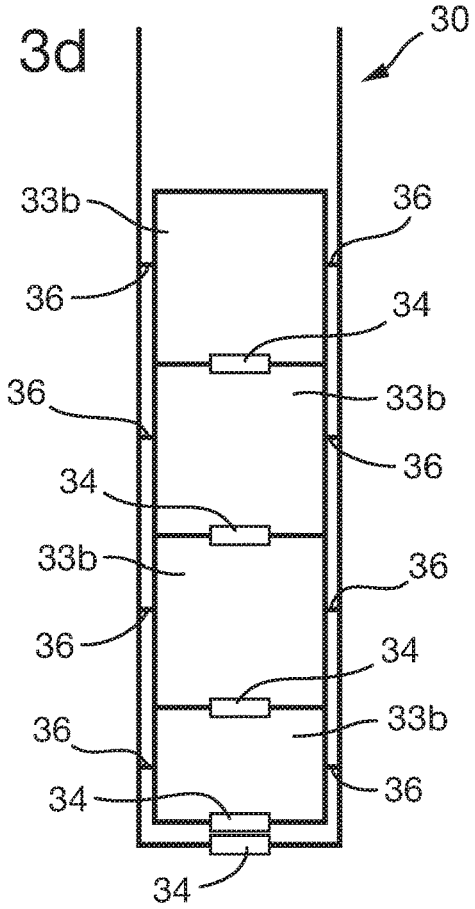

FIG. 3*d* shows an alternative embodiment of the schematic of 3*a* utilising cartridge cases with individual base pad igniter ignition means without a fixed cartridge case fitted.

Figure 4:
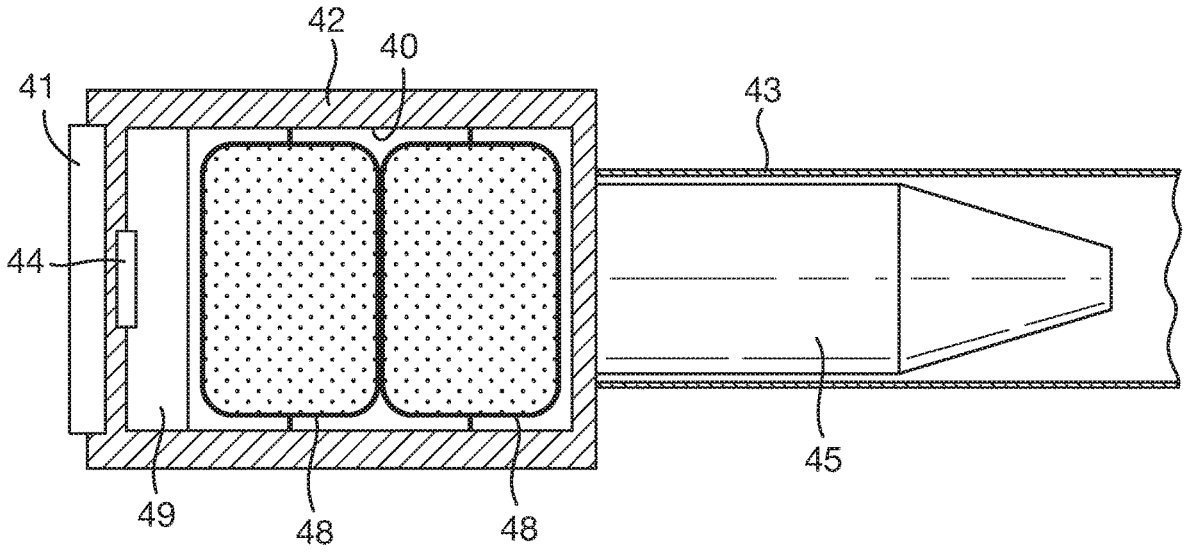

FIG. 4 shows an example charge container installed in a gun breech.

Referring to FIG. 1*a*, a prior art arrangement, there is provided a charge bag 11, with a number of elongate charges 13 inserted therein. The elongate charges 13 are held in position, to reduce movement, by a strap tie 11*a*. The elongate charges 13 may be easily added to or subtracted from the charge bag 11 by releasing the hold of the strap tie 11*a*, pulling out one or more elongate charges 13 and optionally adding a different elongate charge 13 to the charge bag and re-securing the strap tie 11*a*. The amount of charge being selected depending on the distance the projectile is desired to travel. In a calm, well lit scenario it is a simple procedure to group the required energetic elongate charges into the charge bag 11 for use. However the coloured elongate charges 13 are not always clearly visible in a combat scenario and the addition of elongate charges 13 to the charge bag 11 can prove difficult in conditions where movement is restricted.

In FIG. 1*b* the same charge bag 11 is shown, with the elongate charges 13 unpacked to show the various sizes of the elongate charges 13. In a stressed environment and lack of movement, the opportunity for human error is high. Inserting the wrong elongate charge 13 into the charge bag 11 may result in an inaccurate or indeed insufficient propellant for the projectile launch.

Referring to FIGS. 2*a* and 2*b* there is provided a charge container 20 formed from a substantially rigid, combustible material, having a wall 21 which defines a cavity 24 where one or more cartridge cases 23 of energetic material may be inserted in a horizontal stacked formation and be coaxially aligned. At one end of the charge container there is a top portion 19 comprising an aperture 22 to allow the loading and unloading of one or more cartridge cases 23, and the expulsion of gases formed from the exothermic output from the energetic material. The charge container 20 has a base portion 18, which prevents cartridge cases 23 from passing through the charge container 20 and may also house an ignition means or comprise a second aperture 28 for the insertion of such a means. The first cartridge case is the fixed cartridge case 23*a*, which is preferably securely affixed, such that it is not removable from the charge container 20. This ensures that there is always a minimum amount of propellant to ensure any projectile is launched a minimum distance. Further the fixed cartridge case 23*a* in the container 20, may serve as a blank training round, thereby removing the need for a specialist training round.

The further cartridge cases 23 are held within the cavity of the charge container 20, and may be reversibly linked to one another, by a reversible means 26. Further, the charge container or cartridge cases may comprise spacers 27 attached to create a gap 25 between the wall interior 29 of the charge container 20 and each cartridge case 23. The gap 25 created by the use of the spacers 27 then allows the propagation of a flame front, formed by the explosive chain, to travel up the outside of the fixed 23*a* and further cartridge cases 23, to allow more uniform ignite all of the further cartridge cases 23, in a more uniform.

Referring to FIGS. 3*a* and 3*b* there is provided an example charge container 30 showing coaxially and horizontally stacked fixed cartridge case 39 and further cartridge cases 33. The charge container 30 comprises a number of spacers 36 to provide a gap between the cartridge cases 33 and the inner wall of the charge container 30 and the integral fixed cartridge case 39. The fixed cartridge case 39 provides a safety charge and minimum launch distance for the projectile to be launched. A base pad 34 is positioned below the fixed cartridge case 39 to initiate the explosive chain. FIGS. 3*c* and 3*d* show various combinations of the cartridge cases 33*a* and ignition means 34. FIG. 3*c* shows the use of a central core igniter 38, running the length of the charge container 30. The cartridge case 33*a* is formed with a centrally located void to allow the insertion of the central core igniter 38. FIG. 3*d* shows an alternative embodiment of the charge container 30 with no fixed cartridge case and with individual base pad igniters 34 integral to each cartridge case 33*b*. This allows a greater flexibility in cartridge case 33*b* use and cheaper construction of individual charge container devices.

Referring to FIG. 4 there is provided a gun barrel chamber 42. The barrel Chamber volume is substantially filled by the charge container 40. The shell 45 sits typically within the rifled part of the barrel with only a small amount protruding into the barrel chamber.

It is shown that when the breech door 41 is closed the charge container 40 substantially fills the cavity formed by the barrel chamber 42. The charge container 40 has a fixed cartridge container 49 attached towards the base of the charge container 40 in order to ensure the charge container 42 is capable in use of launching the shell 45 to a minimum launch distance. The charge container 42 further comprises a base pad ignitor 44 as its ignition source and two further cartridge containers 48. In use, once the breech door 41 is closed and the gun fired the base pad 44 is struck, which begins the ignition process, wherein the charge containers 48 are ignited and the resulting energy is expelled through the barrel 43 of the gun, forcing the shell 45, which substantially occupies the rifled barrel 42, out of the end of the barrel and towards its target.

The invention claimed is:

1. A charge container device, said charge container device having a volume suitable to substantially fill a barrel chamber, said charge container device is constructed from a substantially rigid and combustible material, wherein said charge container device comprises at least one wall to define a cavity that retains a plurality of cases, said plurality of cases comprising an energetic material, wherein said plurality of cases are arranged in a stacked formation within the cavity defined by the at least one wall of said charge container device, the charge container device further comprising a base portion and a top portion, wherein the top portion comprises an aperture to allow for expulsion of energy and the base portion comprising an igniter;

wherein the charge container device comprises a plurality of spacers fixed to an internal side of the at least one wall of the charge container device;

wherein a first case is laterally between a first pair of spacers;

wherein a second case is laterally between a second pair of spacers; and wherein the first pair of spacers are not fixed to the first case.

2. The device according to claim 1, wherein the plurality of cases comprises (i) a first fixed case at its base portion and (ii) one or more cases stacked on the fixed case, and wherein each of the one or more further cases is detachably attached to an adjacent case by one of: a hook and loop arrangement; or a linking arrangement that an extending portion of one said case and a recessed portion of another said case, wherein the extending portion reversibly inserts into the recessed portion.

3. The device according to claim 1, wherein:

the igniter is at least one of (i) a base pad igniter, located at the base of the charge container device, or (ii) a central core igniter, located at a respective center of each one or more cases, wherein each one or more cases has a centrally located void through which the central core igniter extends; and the device is constructed from a Nitrocellulose and Kraft paper mix, the cases are constructed from a flexible material, and the energetic material within the case is a pellet or granule.

4. A charge container device, said charge container device having a volume suitable to substantially fill a barrel chamber, said charge container device is constructed from a substantially rigid and combustible material, wherein said charge container device comprises at least one wall to define a cavity that is configured to retain a plurality of cases, one or more cases of the plurality of cases comprising an energetic material, wherein the plurality of cases are arranged in a stacked formation within said charge container device, the charge container device further comprising a base portion and a top portion, wherein the top portion comprises an aperture to allow for expulsion of energy and the base portion comprising an igniter, wherein the plurality of cases comprises (i) a fixed case that is fixed at the base portion so as to be non-removable from the cavity, and (ii) one or more removable cases that are detachably attached in a stacked configuration on the fixed case, wherein the charge container device comprises a plurality of spacers fixed to an internal side of the at least one wall of the charge container device, the plurality of spacers comprising at least (i) a first spacer and a second spacer, such that the fixed case is laterally between the first spacer and the second spacer, and (ii) a third spacer and a fourth spacer that are configured to hold a removable case under friction, and wherein the plurality of spacers form a gap between the plurality of cases and the internal side of the at least one wall.

5. The device according to claim 4, wherein the charge container device is constructed from a Nitrocellulose and Kraft paper mix, and wherein the cases are constructed from a flexible material.

6. The device according to claim 5, wherein the flexible material includes one or both of cotton and polyester.

7. The device according to claim 4, wherein:

the plurality of spacers further comprises a fifth spacer and a sixth spacer that are configured to hold another removable case under friction.

8. The device according to claim 4, wherein the gap is between 1 mm-10 mm.

9. The device according to claim 4, wherein the plurality of cases within the charge container device are arranged in a stack such that they are coaxially aligned with one another.

10. The device according to claim 4, wherein the igniter is a base pad igniter, located at the base of the charge container device.

11. The device according to claim 4, wherein:

the igniter is a central core igniter, located at the respective center of each one or more cases; and each one or more cases has a centrally located void through which the central core igniter extends.

12. The device according to claim 4, wherein the energetic material within the one or more cases is a pellet or granule.

13. The charge container device of claim 4, wherein the fixed case allows the charge container device to serve as a blank training round when the charge container device is not paired with a projectile munition.

14. The charge container device of claim 4, wherein the fixed case includes an amount of said energetic material to ensure a projectile munition paired with the charge container device will be launched a threshold distance.

15. The charge container device of claim 4, wherein at least a first removable case is detachably attached to at least one of an adjacent second removable case or the fixed case by:

a hook and loop arrangement;

a linking arrangement that includes an extending portion of one said case and a recessed portion of another said case, wherein the extending portion reversibly inserts into the recessed portion; and/or an arrangement configured to inhibit movement of said cases, the arrangement including a first surface of one said case and a second surface of another said case, wherein at least one of the first and second surfaces includes an abrasive surface or a surface with raised portions, and wherein the abrasive surface or surface with raised portions increases the co-efficiency of the first and second surfaces such that when the first and second surfaces are in contact with one another they are resilient to movement.

16. A charge container device, said charge container device having a volume suitable to substantially fill a barrel chamber, said charge container device is constructed from a substantially rigid and combustible material, wherein said charge container device comprises at least one wall to define a cavity that retains a plurality of cases, one or more cases of the plurality of cases comprising an energetic material, wherein the plurality of cases are arranged in a stacked formation within said charge container device, the charge container device further comprising a base portion and a top portion, wherein the top portion comprises an aperture to allow for expulsion of energy and the base portion comprising an igniter, wherein the plurality of cases comprises (i) a fixed case that is fixed at the base portion so as to be non-removable from the cavity, and (ii) one or more removable cases that are detachably attached in a stacked configuration on the fixed case, wherein the plurality of cases are inside the cavity defined by the at least one wall of the charge container device, and wherein one or more cases of the removable cases are detachably attached to an interior side of the at least one wall of the charge container device by a detachable hook and loop arrangement.

17. The device according to claim 16, the plurality of cases within the charge container device are arranged in a stack such that they are coaxially aligned with one another.

18. The device according to claim 16, wherein at least a first removable case is detachably attached to at least one of an adjacent second removable case or the fixed case by:

a hook and loop arrangement;

a linking arrangement that includes an extending portion of one said case and a recessed portion of another said case, wherein the extending portion reversibly inserts into the recessed portion; and/or an arrangement configured to inhibit movement of said cases, the arrangement including a first surface of one said case and a second surface of another said case, wherein at least one of the first and second surfaces includes an abrasive surface or a surface with raised portions, and wherein the abrasive surface or surface with raised portions increases the co-efficiency of the first and second surfaces such that when the first and second surfaces are in contact with one another they are resilient to movement.

19. The device according to claim 16, wherein at least one of:

the igniter is a base pad igniter, located at the base of the charge container device; or the igniter is a central core igniter, located at the respective center of each one or more cases, and each one or more cases has a centrally located void through which the central core igniter extends.

20. A method of forming a munition charge using a charge container, said charge container having a volume suitable to substantially fill a barrel chamber, said charge container being constructed from a substantially rigid and combustible material, wherein said charge container comprises at least one wall to define a cavity for the retention of a plurality of cases, said plurality of cases comprising an energetic material, wherein said plurality of cases are arranged in a stacked formation within said charge container, the charge container further comprising a base portion and a top portion, wherein the top portion comprises an aperture to allow for expulsion of energy and the base portion comprising an igniter, the method comprising:

loading the plurality of cases to the cavity formed by the at least one wall, wherein an inner side of the at least one wall has a plurality of spacers fixed thereon; and aligning said plurality of cases coaxially, wherein a first case is aligned with respect to the at least one wall by at least a first spacer and a second spacer, and wherein a second case is aligned with respect to the at least one wall by at least a third spacer and a fourth spacer, wherein the first, second, third, and fourth spacers are fixed on the inner side of the at least one wall, wherein the first and second spacers hold the first case under friction, such that the first case is removably loaded within a first space defined by at least the first and second spacers, and wherein the third and fourth spacers hold the second case under friction, such that the second case is removably loaded within a second space defined by at least the third and fourth spacers.

* * * * *